US009947295B2

(12) United States Patent
Ahn et al.

(10) Patent No.: US 9,947,295 B2
(45) Date of Patent: Apr. 17, 2018

(54) METHOD OF DRIVING A DISPLAY PANEL AND A DISPLAY APPARATUS FOR PERFORMING THE SAME

(71) Applicant: SAMSUNG DISPLAY CO., LTD., Yongin, Gyeonggi-Do (KR)

(72) Inventors: Ik-Hyun Ahn, Hwaseong-Si (KR); Jung-Deok Seo, Cheonan-Si (KR); Bong-Im Park, Asan-Si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 77 days.

(21) Appl. No.: 14/836,005

(22) Filed: Aug. 26, 2015

(65) Prior Publication Data

US 2016/0163287 A1 Jun. 9, 2016

(30) Foreign Application Priority Data

Dec. 4, 2014 (KR) ..... 10-2014-0173263

(51) Int. Cl.
*G09G 5/12* (2006.01)
*G09G 3/36* (2006.01)

(52) U.S. Cl.
CPC ..... *G09G 5/12* (2013.01); *G09G 3/3677* (2013.01); *G09G 2230/00* (2013.01);
(Continued)

(58) Field of Classification Search
CPC ..... G09G 2230/00; G09G 2310/06; G09G 2310/0267; G09G 2310/067; G09G 2310/08; G09G 2320/0223; G09G 2320/0233; G09G 2320/0693; G09G 3/3677; G09G 5/12
See application file for complete search history.

(56) References Cited

U.S. PATENT DOCUMENTS

2009/0179875 A1* 7/2009 Li ..... G09G 3/3648 345/204
2012/0162185 A1* 6/2012 Park ..... G09G 3/3611 345/212
(Continued)

FOREIGN PATENT DOCUMENTS

KR 1020000056479 9/2000
KR 1020010082963 8/2001
(Continued)

OTHER PUBLICATIONS

Search Report dated Jul. 20, 2016 from the European Patent Office in corresponding European Patent Application No. 15197732.9.

*Primary Examiner* — Latanya Bibbins
(74) *Attorney, Agent, or Firm* — F. Chau & Associates, LLC

(57) ABSTRACT

A method of driving a display device including a display panel is provided. The display panel includes a plurality of gate lines. The gate lines are divided into a plurality of gate line groups. The method includes applying different gate delay values to each of the gate line groups to generate gate signals and outputting the gate signals to the gate lines. A first gate delay value is applied to at least one of the gate lines during a first frame and a second gate delay value different from the first delay value is applied to the at least one of the gate lines during a second frame.

23 Claims, 16 Drawing Sheets

(52) U.S. Cl.
CPC . *G09G 2310/0267* (2013.01); *G09G 2310/06* (2013.01); *G09G 2310/067* (2013.01); *G09G 2310/08* (2013.01); *G09G 2320/0223* (2013.01); *G09G 2320/0233* (2013.01); *G09G 2320/0693* (2013.01)

(56) References Cited

U.S. PATENT DOCUMENTS

| | | | | |
|---|---|---|---|---|
| 2012/0287100 | A1* | 11/2012 | Woo ..... | G09G 3/3651 345/209 |
| 2014/0232713 | A1 | 8/2014 | Hsu et al. | |
| 2015/0022512 | A1 | 1/2015 | Ahn et al. | |

FOREIGN PATENT DOCUMENTS

| | | |
|---|---|---|
| KR | 1020050059523 | 6/2005 |
| KR | 1020130116700 | 10/2013 |

* cited by examiner

METHOD OF DRIVING A DISPLAY PANEL AND A DISPLAY APPARATUS FOR PERFORMING THE SAME

CROSS-REFERENCE TO RELATED PATENT APPLICATION

This application claims priority under 35 U.S.C. §119 to Korean Patent Application No. 10-2014-0173263, filed on Dec. 4, 2014, in the Korean Intellectual Property Office KIPO, the disclosure of which is incorporated by reference herein in its entirety.

TECHNICAL FIELD

Exemplary embodiments of the present invention relate to a display method and a display apparatus, more particularly, to a method of driving a display panel and a display apparatus performing the method.

DISCUSSION OF THE RELATED ART

A display apparatus may include a display panel that displays an image and a panel driver that drives the display panel. The display panel includes a plurality of gate lines, a plurality of data lines, and a plurality of pixels connected to the gate lines and the data lines.

The panel driver includes a gate driver generating a gate signal and a data driver generating a data voltage. The gate line transmits the gate signal to the pixel, and the data line transmits the data voltage to the pixel.

A propagation delay of a data voltage applied to a pixel may increase as a distance from the pixel to the panel driver increases.

When the data voltage is delayed, pixel activation based on the gate signal may not coincide with the arrival of the data voltage, and thus, a charging rate of the pixel may be decreased.

SUMMARY

According to an exemplary embodiment of the present invention, a method of driving a display device including a display panel is provided. The display panel includes a plurality of gate lines. The method includes applying different gate delay values to each of the plurality of gate line groups to generate gate signals and outputting the gate signals to the gate lines. The gate lines of the display panel are divided into the gate line groups. A first gate delay value is applied to at least one of the gate lines during a first frame. A second gate delay value different from the first gate delay value is applied to the at least one of the gate lines during a second frame.

In an exemplary embodiment of the present invention, a gate delay value applied to a P-th gate line group of the gate line groups may be less than a gate delay value applied to a Q-th gate line group of the gate line groups. The P-th gate line group may be closer than the Q-th gate line group to a data driver of the display device. P and Q may be positive integers.

In an exemplary embodiment of the present invention, a gate delay value applied to the P-th gate line group during the first frame may be X. A gate delay value applied to the P-th gate line group during the second frame may be (X+a). X and a may be positive real numbers.

In an exemplary embodiment of the present invention, a gate delay value applied to the P-th gate line group during a third frame may be (X−a).

In an exemplary embodiment of the present invention, a gate delay value applied to the P-th gate line group during the first time may be X. A gate delay value applied to a first gate line of the P-th gate line group during the second frame may be (X+a) and a gate delay value applied to gate lines of the P-th gate line group except for the first gate line of the P-th gate line group during the second frame may be X. X and a may be positive real numbers.

In an exemplary embodiment of the present invention, a last gate line in the P-th gate line group may be a Y-th gate line of the gate lines during the first frame. The last gate line of the P-th gate line group may be a (Y+b)-th gate line of the gate lines during the second frame. Y and b may be positive integers.

In an exemplary embodiment of the present invention, the last gate line of the P-th gate line group may be a (Y−b)-th gate line of the gate lines during a third frame.

In an exemplary embodiment of the present invention, a gate clock signal may be generated based on the first gate delay value or the second gate delay value. The gate signals may be generated based on the gate clock signal.

In an exemplary embodiment of the present invention, the gate signals may be synchronized with a load signal corresponding to an output timing of a data voltage to a data line of the display device. The first gate delay value or the second gate delay value may be defined with respect to the load signal.

According to an exemplary embodiment of the present invention, a display apparatus is provided. The display apparatus includes a display panel, a gate driver, a data driver and a signal controller. The display panel includes a plurality of gate lines and a plurality of data lines. The gate lines are divided into a plurality of gate line groups. The gate driver is configured to apply different gate delay values to each of the gate line groups to generate gate signals and to output the gate signals to the gate lines. The data driver is configured to output data voltages to the data lines. The signal controller is configured to control the gate driver and the data driver. A first gate delay value is applied to at least one of the gate lines during a first frame and a second gate delay value different from the first gate delay value is applied to the at least one of the gate lines during a second frame.

In an exemplary embodiment of the present invention, a gate delay value applied to a P-th gate line group of the gate lines groups may be less than a gate delay value applied to a Q-th gate line group of the gate line groups. The P-th gate line group may be closer than the Q-th gate line group to a data driver of the display device. P and Q may be positive integers.

In an exemplary embodiment of the present invention, a gate delay value applied to the P-th gate line group during the first frame may be X. A gate delay value applied to the P-th gate line group during the second frame may be (X+a). X and a may be positive real numbers.

In an exemplary embodiment of the present invention, a gate delay value applied to the P-th gate line group during a third frame may be (X−a).

In an exemplary embodiment of the present invention, a gate delay value applied to the P-th gate line group during the first frame may be X. A gate delay value applied to a first gate line of the P-th gate line group during the second frame may be (X+a) and a gate delay value applied to gate lines of the P-th gate line group except for the first gate line of the P-th gate line group during the second frame may be X. X and a may be positive real numbers.

In an exemplary embodiment of the present invention, a last gate line of the P-th gate line group may be a Y-th gate line during the first frame. The last gate line of the P-th gate line group may be a (Y+b)-th gate line of the gate lines during the second frame. Y and b may be positive integers.

In an exemplary embodiment of the present invention, the last gate line of the P-th gate line group may be a (Y−b)-th gate line of the gate lines during a third frame.

In an exemplary embodiment, the signal controller may be configured to generate a gate clock signal based on the first gate delay value or the second gate delay value. The gate driver may be configured to generate the gate signals based on the gate clock signal.

In an exemplary embodiment of the present invention, the signal controller may be configured to generate a load signal corresponding to an output timings of the data voltages to the data lines. The gate signals may be synchronized with the load signal. The first gate delay value or the second gate delay value may be defined with respect to the load signal.

According to an exemplary embodiment of the present invention, a method of driving a display device is provided. The display device includes a display panel. The display panel includes a plurality of gate lines including a plurality of gate line groups. The method includes applying different gate delay values to each of the plurality of gate line groups to generate gate signals and outputting the gate signals to the gate lines. A gate delay value applied to a P-th gate line group of the gate line groups is less than a gate delay value of a Q-th gate line group of the gate line groups. The P-th gate line group is closer than the Q-th gate line group to a data driver of the display device. P and Q are positive integers.

In an exemplary embodiment of the present invention, a first gate delay value may be applied to at least one of the gate lines during a first frame. A second gate delay value different from the first gate delay value may be applied to the at least one of the gate lines during a second frame.

In an exemplary embodiment of the present invention, a gate clock signal may be generated based on the first gate delay value or the second gate delay value. The gate signals may be generated based on the gate clock signal.

In an exemplary embodiment of the present invention, a gate delay value applied to the P-th gate line group during a first frame may be X, a gate delay value applied to the P-th gate line group during a second frame may be (X+a), and a gate delay value applied to the P-th gate line group during a third frame is (X−a). X and a may be positive real numbers.

In an exemplary embodiment of the present invention, the gate signals may be synchronized with a load signal corresponding to an output timing of a data voltage to a data line of the display device.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EMBODIMENTS

Figure 1:
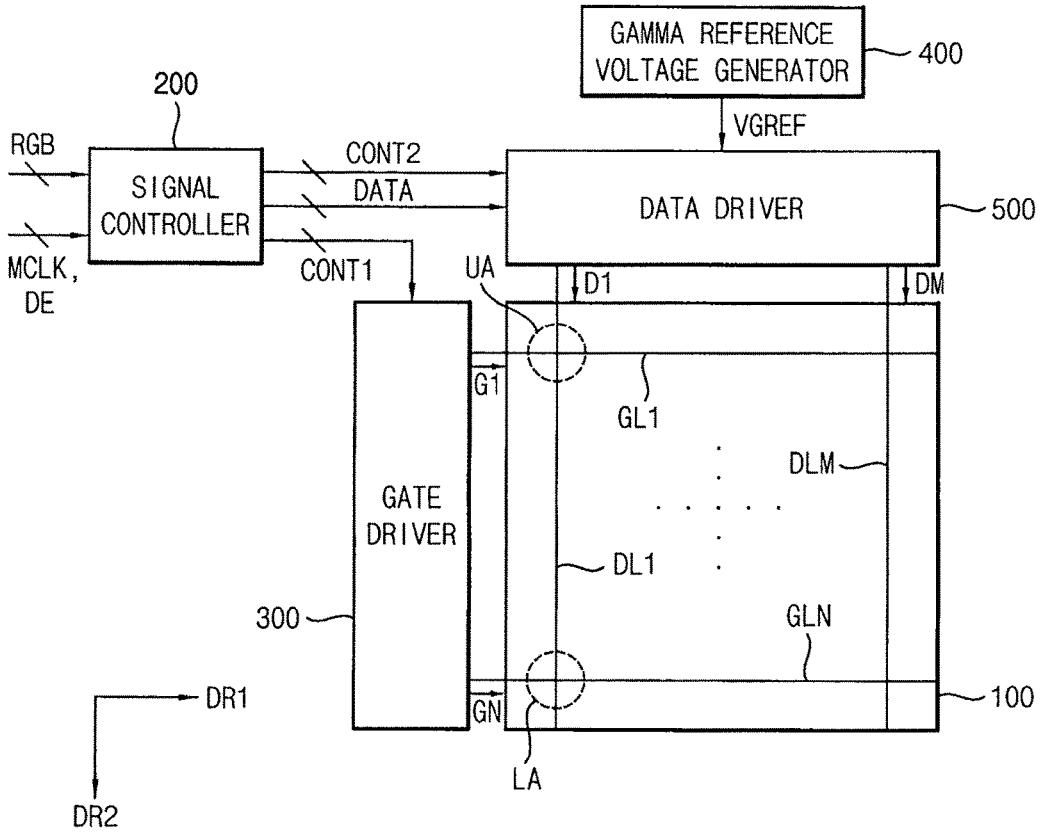
FIG. 1 is a block diagram illustrating a display apparatus according to an exemplary embodiment of the present invention.

Like reference numerals may designate like elements throughout the specification and drawings.

Hereinafter, exemplary embodiments of the present invention will be explained in detail with reference to the accompanying drawings.

FIG. 1 is a block diagram illustrating a display apparatus according to an exemplary embodiment of the present invention.

Referring to FIG. 1, the display apparatus includes a display panel 100, a signal controller 200, a gate driver 300, a gamma voltage generator 400, and a data driver 500.

The display panel 100 includes a plurality of gate lines GL1 to GLN, a plurality of data lines DL1 to DLM, and a plurality of pixels. Each of the pixels may be electrically connected to a corresponding one of the gate lines GL1 to GLN and a corresponding one of the data lines DL1 to DLM. Here, N and M are natural numbers. The gate lines GL1 to GLN extend in a first direction DR1, and the data lines DL1 to DLM extend in a second direction DR2 crossing the first direction DR1. Each pixel includes a switching element, a liquid crystal capacitor, and a storage capacitor. The liquid crystal capacitor and the storage capacitor are electrically connected to the switching element. The pixels are arranged in a matrix form.

The signal controller 200 receives an input image data and an input control signal from an external apparatus. The input image data may include a red image data R, a green image data G, and a blue image data B. The input control signal includes a master clock signal MCLK and a data enable signal DE. The input control signal may further include a vertical synchronizing signal and a horizontal synchronizing signal.

The signal controller 200 generates a first control signal CONT1, a second control signal CONT2, and a data signal DATA based on the input image data and the input control signal. The signal controller 200 generates the first control signal CONT1 for controlling a driving timing of the gate driver 300 based on the input control signal, and outputs the first control signal CONT1 to the gate driver 300. The signal controller 200 generates the second control signal CONT2 for controlling a driving timing of the data driver 500 based on the input control signal, and outputs the second control signal CONT2 to the data driver 500. An operation of the signal controller 200 will be described in detail with reference to FIG. 2.

The first control signal CONT1 includes a vertical start signal and a gate clock signal. The second control signal CONT2 includes a horizontal start signal and a load signal.

The gate driver 300 generates gate signals G1 to GN for driving the gate lines GL1 to GLN in response to the first control signal CONT1 received from the signal controller 200. The gate driver 300 sequentially outputs the gate signals G1 to GN to the gate lines GL1 to GLN, respectively.

The gate driver 300 may be directly mounted on the display panel 100, or may be connected to the display panel 100 as a tape carrier package (TCP) type. In an exemplary embodiment of the present invention, the gate driver 300 may be integrated on the display panel 100.

The gamma voltage generator 400 generates a gamma reference voltage VGREF. The gamma voltage generator 400 provides the gamma reference voltage VGREF to the data driver 500. The gamma reference voltage VGREF has a value corresponds to a level of the data signal DATA. The gamma voltage generator 400 may be disposed in the signal controller 200, or in the data driver 500.

The data driver 500 receives the second control signal CONT2 and the data signal DATA from the signal controller 200, and receives the gamma reference voltages VGREF from the gamma voltage generator 400. The data driver 500 converts the data signal DATA into data voltages D1 to DM having an analogue type using the gamma reference voltages VGREF. The data driver 500 sequentially outputs the data voltages D1 to DM to the data lines DL1 to DLM, respectively.

The data driver 500 may include a shift register, a latch, a signal processor, and a buffer. The shift register outputs a latch pulse to the latch. The latch temporarily stores the data signal DATA, and outputs the data signal DATA. The signal processor generates the data voltages D1 to DM having an analogue type based on the data signal DATA having a digital type and the gamma reference voltages VGREF to output the data voltages D1 to DM to the buffer. The buffer compensates the data voltages D1 to DM to have a uniform level, and outputs the compensated data voltages D1 to DM to the data lines DL1 to DLM, respectively.

The data driver 500 may be directly mounted on the display panel 100, or be connected to the display panel 100 in a TCP type. In an exemplary embodiment of the present invention, the data driver 500 may be integrated on the display panel 100.

Figure 2:
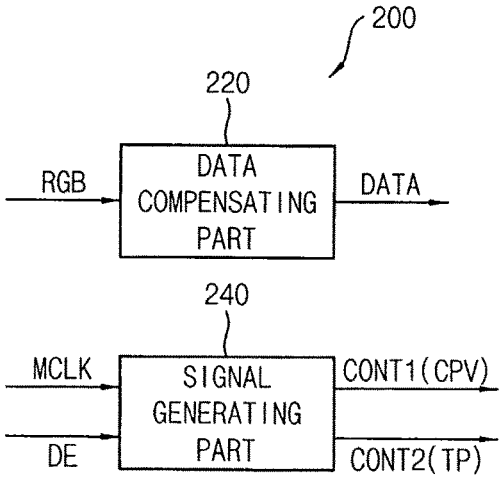
FIG. 2 is a block diagram illustrating a signal controller of FIG. 1 according to an exemplary embodiment of the present invention.

FIG. 2 is a block diagram illustrating a signal controller 200 of FIG. 1 according to an exemplary embodiment of the present invention.

Referring to FIG. 2, the signal controller 200 includes a data compensating part 220 and a signal generating part 240. Although the signal controller 200 is illustrated as being divided into the parts 220 and 240 for convenience of explanation, the signal controller 200 may not be divided into the parts 220 and 240.

The data compensating part 220 receives the input image data RGB from an external apparatus. The data compensating part 220 compensates the input image data RGB to generate the data signal DATA. The data compensating part 220 outputs the data signal DATA to the data driver 500.

The data compensating part 220 may include a color characteristic compensating part and a dynamic capacitance compensating part.

The color characteristic compensating part may receive the input image data RGB, and perform an adaptive color correction (ACC). The color characteristic compensating part may compensate the input image data RGB using a gamma curve.

The dynamic capacitance compensating part may perform a dynamic capacitance compensation (DCC) to compensate present frame data using previous frame data and the present frame data.

The signal generating part 240 receives the master clock signal MCLK and the data enable signal DE from outside.

The signal generating part 240 generates the first control signal CONT1 based on the master clock signal MCLK and the data enable signal DE to output the first control signal CONT1 to the gate driver 300. The first control signal CONT1 includes a gate clock signal CPV. The gate driver 300 generates a gate signal using the gate clock signal CPV.

The signal generating part 240 generates the second control signal CONT2 based on the master clock signal MCLK and the data enable signal DE to output the second control signal CONT2 to the data driver 500. The second control signal CONT2 includes a load signal TP. The load signal TP adjusts an output timing of the data voltage in the data driver 500. The gate clock signal CPV and the load signal TP are synchronized with each other.

Figure 3A:
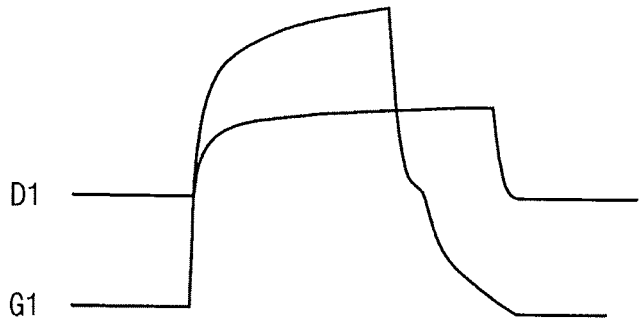
FIG. 3A is a waveform diagram illustrating a gate signal and a data voltage at an upper portion of a display panel of FIG. 1 according to an exemplary embodiment of the present invention.
Figure 3B:
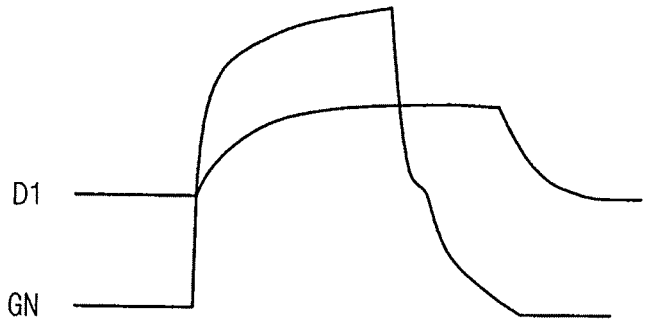
FIG. 3B is a waveform diagram illustrating a gate signal and a data voltage at a lower portion of the display panel of FIG. 1 according to an exemplary embodiment of the present invention.
Figure 4:
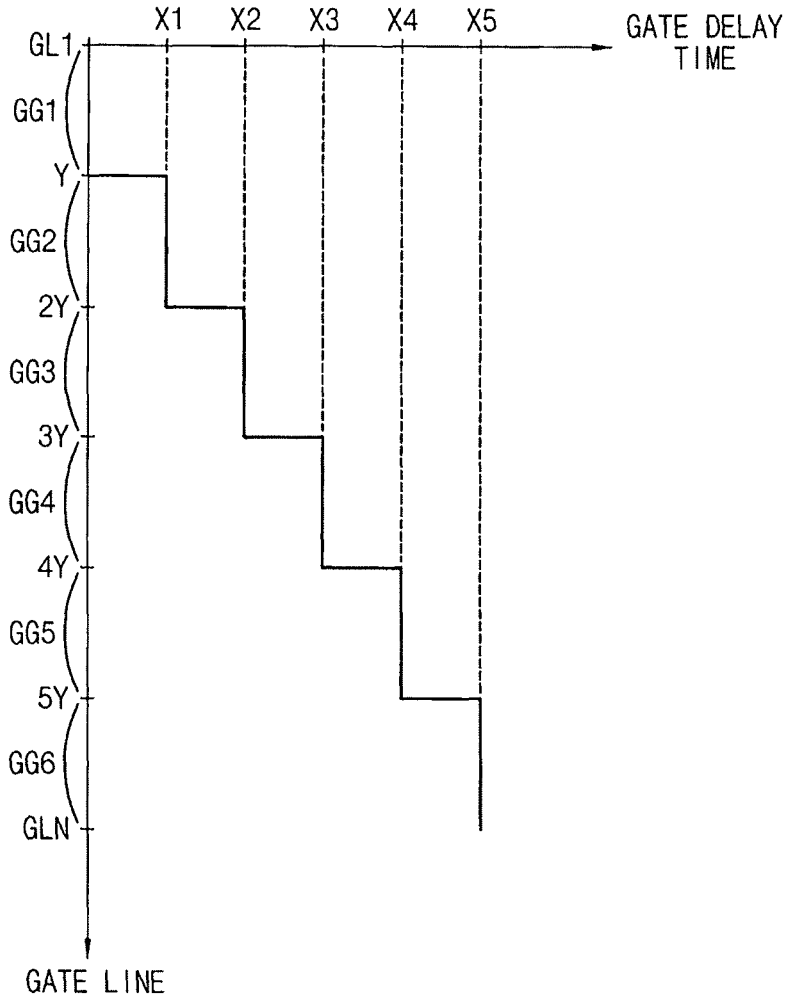
FIG. 4 is a graph illustrating gate delay values of gate signals for gate lines of FIG. 1 according to an exemplary embodiment of the present invention.
Figure 5:
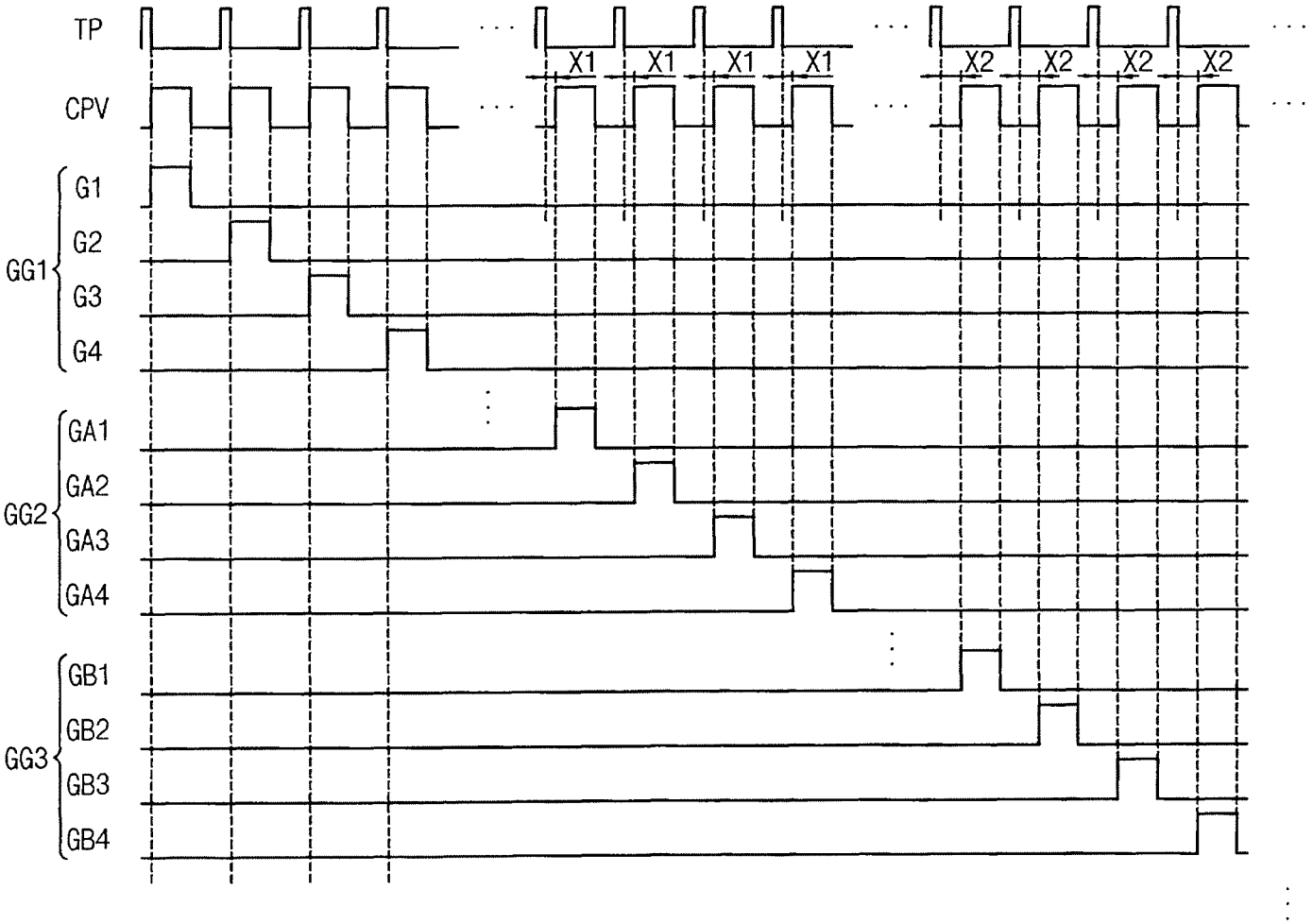
FIG. 5 is a waveform diagram illustrating gate signals applied to gate lines of FIG. 1 according to an exemplary embodiment of the present invention.

FIG. 3A is a waveform diagram illustrating a gate signal and a data voltage at an upper portion UA of a display panel 100 of FIG. 1 according to an exemplary embodiment of the present invention. FIG. 3B is a waveform diagram illustrating a gate signal and a data voltage at a lower portion LA of the display panel 100 of FIG. 1 according to an exemplary embodiment of the present invention. FIG. 4 is a graph illustrating gate delay values of gate signals for gate lines of FIG. 1 according to an exemplary embodiment of the present invention. FIG. 5 is a waveform diagram illustrating gate signals applied to gate lines of FIG. 1 according to an exemplary embodiment of the present invention.

A propagation delay of a data voltage may increase as a distance from the data driver 500 to a pixel corresponding to the data voltage increases. The propagation delay may be understood as a delay in timing of the data voltage applied to the pixel. For example, a timing of a data voltage applied to a pixel far from the data driver 500 may be later than a timing of a data voltage applied to a pixel close to the data driver 500. As a size of the display panel 100 increases, the propagation delay of the data voltage may increase.

Referring to FIGS. 1, 3A, and 3B, the propagation delay of the data voltage may be relatively short in the upper portion UA of the display panel 100 which is close to the data driver 500. In addition, the propagation delay of the data voltage may be relatively long in the lower portion LA of the display panel 100 which is far from the data driver 500.

The gate signals G1 to GN are synchronized with the load signal TP and sequentially outputted as pulse wave types. For example, the first gate signal G1 is outputted as a pulse wave, the second gate signal G2 is outputted as a pulse wave, and the third gate signal G3 is outputted as a pulse wave. The N-th gate signal GN is outputted as a pulse wave.

In a display panel, all of the first to N-th gate signals may be synchronized with the load signal TP or the first to N-th gate signals may have substantially the same time delay from respective falling edges of the load signal TP. For example, the first gate signal G1 may be activated at a falling edge of a first pulse of the load signal TP, the second gate signal G2 may be activated at a falling edge of a second pulse of the load signal TP, and the third gate signal G3 may be activated at a falling edge of a third pulse of the load signal TP. Thus, the N-th gate signal GN may be activated at a falling edge of an N-th pulse of the load signal TP.

As shown in FIG. 3A, a propagation delay of a first data voltage corresponding to a first pixel in the upper portion UA may be relatively short. In this case, an output timing of the first data voltage may coincide with a turn-on timing of a gate signal, and thus, a sufficient charging time and rate for the first pixel may be achieved. In addition, as shown in FIG. 3B, a propagation delay of a second data voltage corresponding to a second pixel in the lower portion LA may be relatively long. In this case, an output timing of the second data voltage may be later than a turn-on timing of a gate signal, and thus, the charging rate of the second pixel may be insufficient.

Referring to FIG. 4, the gate lines GL1 to GLN of the display panel 100 are divided into a plurality of gate line groups GG1, GG2, GG3, GG4, GG5, and GG6. However, the number of the gate line groups of the present invention is not limited thereto.

A vertical axis of the graph in FIG. 4 represents positions of the gate lines. For example, a first gate line group GG1 may include a first gate line GL1 to a Y-th gate line GLY. A second gate line group GG2 may include a (Y+1)-th gate line GL(Y+1) to a 2Y-th gate line GL2Y. A third gate line group GG3 may include a (2Y+1)-th gate line GL(2Y+1) to a 3Y-th gate line GL3Y. A fourth gate line group GG4 may include a (3Y+1)-th gate line GL(3Y+1) to a 4Y-th gate line GL4Y. A fifth gate line group GG5 may include a (4Y+1)-th gate line GL(4Y+1) to a 5Y-th gate line GL5Y. A sixth gate line group GG6 may include a (5Y+1)-th gate line GL(5Y+1) to a 6Y-th gate line GL6Y. For example, the number of the gate lines of each gate line group GG1, GG2, GG3, GG4, GG5, and GG6 may be substantially the same as one another. In an exemplary embodiment of the present invention, a difference in the number of the gate lines of each gate line group GG1, GG2, GG3, GG4, GG5, and GG6 may be equal to or less than a predetermined value (e.g., one).

For example, no gate delay value is applied to first-group gate lines GL1 to GLY corresponding to the first gate line group GG1. A gate delay value X1 is applied to second-group gate lines GL(Y+1) to GL2Y corresponding to the second gate line group GG2. A gate delay value X2 is applied to third-group gate lines GL(2Y+1) to GL3Y corresponding to the third gate line group GG3. A gate delay value X3 is applied to fourth-group gate lines GL(3Y+1) to GL4Y corresponding to the fourth gate line group GG4. A gate delay value X4 is applied to fifth-group gate lines GL(4Y+1) to GL5Y corresponding to the fifth gate line group GG5. A gate delay value X5 is applied to sixth-group gate lines GL(5Y+1) to GL6Y corresponding to the sixth gate line group GG6. X2 is greater than X1. X3 is greater than X2. X4 is greater than X3. X5 is greater than X4. For example, X2 may be twice of X1. X3 may be three times of X1. X4 may be four times of X1. X5 may be five times of X1. For example, X2, X3, X4, and X5 might not be an integer multiple of X1. In an exemplary embodiment of the present invention, a gate delay value of X0 less than X1 may be applied to the first-group gate lines GL1 to GLY corresponding to the first gate line group GG1.

The gate delay value is not applied to the gate signals applied to the gate lines of the first gate line group GG1 so that the gate signals applied to the gate lines of the first gate line group GG1 have a first gate turn-on start timing. A gate turn-on start timing may be a moment when the gate signal starts to turn on after a falling edge of the load signal TP. The gate lines of the second gate line group GG2 have a second gate turn-on start timing which is delayed from the first gate turn-on start timing by X1. The gate lines of the third gate line group GG3 have a third gate turn-on start timing which is delayed from the first gate turn-on start timing by X2. The gate lines of the fourth gate line group GG4 have a fourth gate turn-on start timing which is delayed from the first gate turn-on start timing by X3. The gate lines of the fifth gate line group GG5 have a fifth gate turn-on start timing which is delayed from the first gate turn-on start timing by X4. The gate lines of the sixth gate line group GG6 have a fifth gate turn-on start timing which is delayed from the first gate turn-on start timing by X5. Thus, the first gate turn-on start timing may be earlier than any other gate turn-on start timings (e.g., the second to fifth gate turn-on start timings).

Referring to FIG. 5, the gate signals G1 to G4 of the first-group gate lines corresponding to the first gate line group GG1 are turned on at a falling edge of the load signal TP. Although the gate signals G1 to G4 of the gate lines of the first gate line group GG1 are turned on at the falling edge of the load signal TP in FIG. 5, the present invention is not limited thereto. In an exemplary embodiment of the present invention, the gate signals G1 to G4 of the first-group gate lines corresponding to the first gate line group GG1 are turned on after the falling edge of the load signal TP.

The gate signals GA1 to GA4 of the second-group gate lines corresponding to the second gate line group GG2 are turned on later than the gate signals G1 to G4 of the first-group gate lines corresponding to the first gate line group GG1 by the gate delay value X1. For example, the gate signals GA1 to GA4 of the second-group gate lines corresponding to the second gate line group GG2 are turned on later than respective falling edges of the load signal TP by the gate delay value X1.

The gate signals GB1 to GB4 of the third-group gate lines corresponding to the third gate line group GG3 are turned on later than the gate signals G1 to G4 of the first-group gate lines corresponding to the first gate line group GG1 by the gate delay value X2. For example, the gate signals GB1 to GB4 of the third-group gate lines corresponding to the third gate line group GG3 are turned on later than respective falling edges of the load signal TP by the gate delay value X2.

As described above, a gate delay value applied to gate signals varies according to a position of a gate line, and thus, the decrease of the charging time or the charging rate of a pixel, caused by the propagation delay of the data voltage, may be compensated. A horizontal line defect may be generated in borders among adjacent gate line groups (e.g., a border between the first gate line group GG1 and the second gate line group GG2, or a border between the second gate line group GG2 and the third gate line group GG3).

Figure 6A:
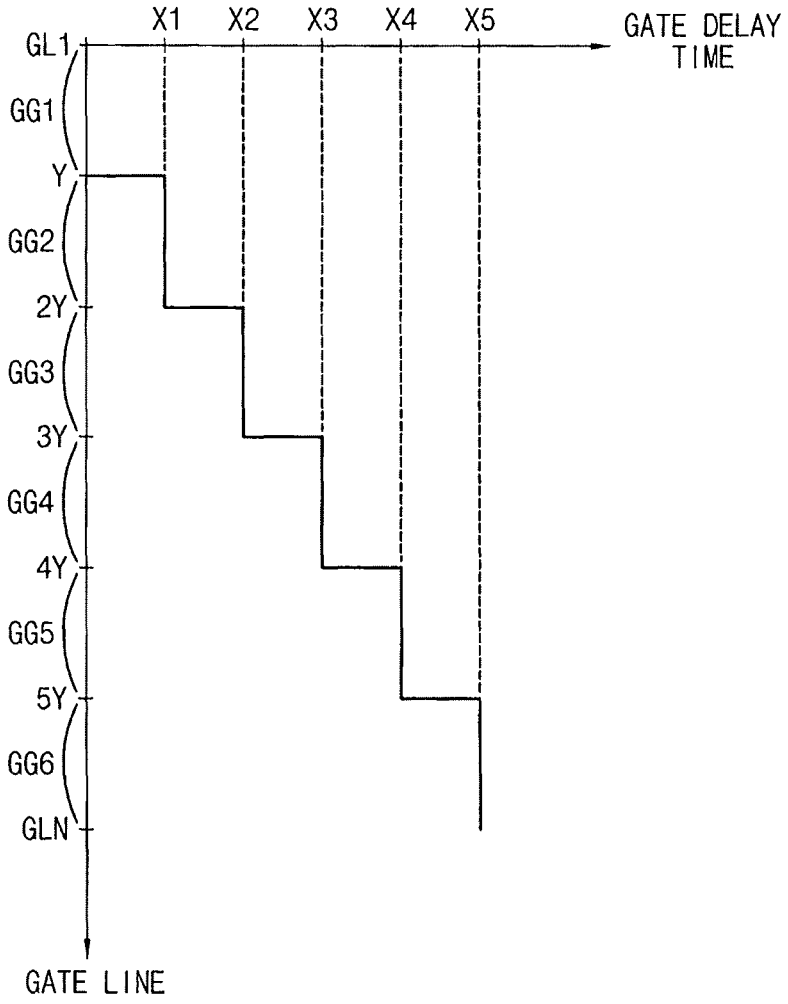
FIG. 6A is a graph illustrating gate delay values of gate signals for gate lines of FIG. 1 during a first frame according to an exemplary embodiment of the present invention.
Figure 6B:
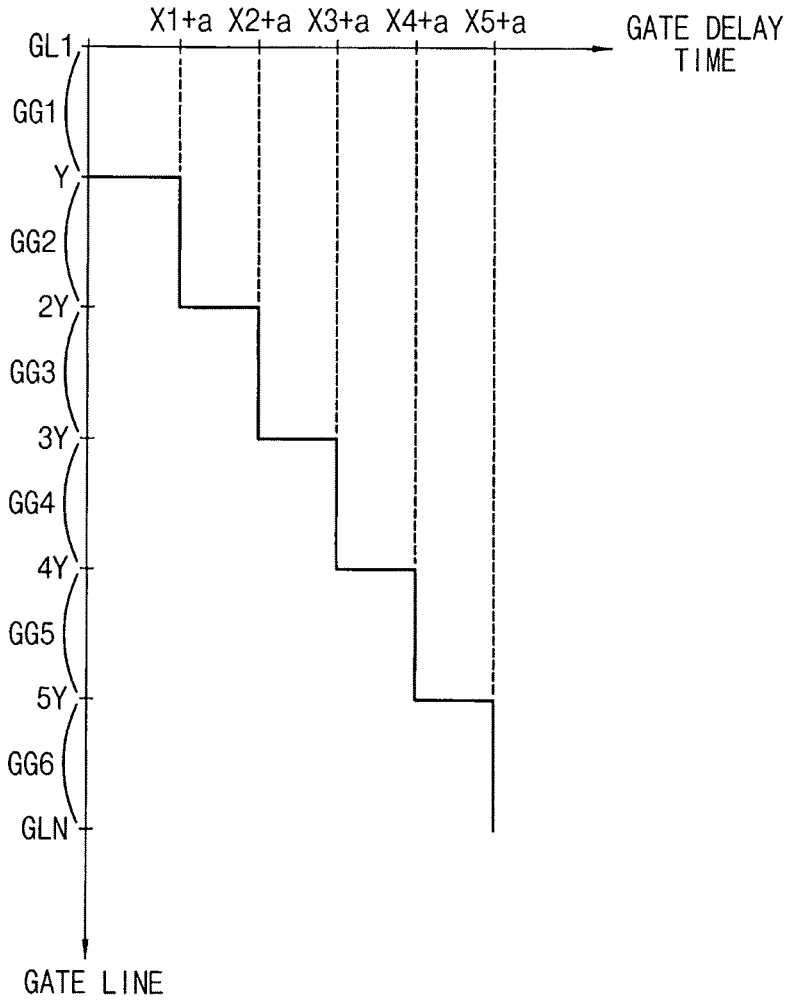
FIG. 6B is a graph illustrating gate delay values of gate signals for gate lines of FIG. 1 during a second frame according to an exemplary embodiment of the present invention.
Figure 6C:
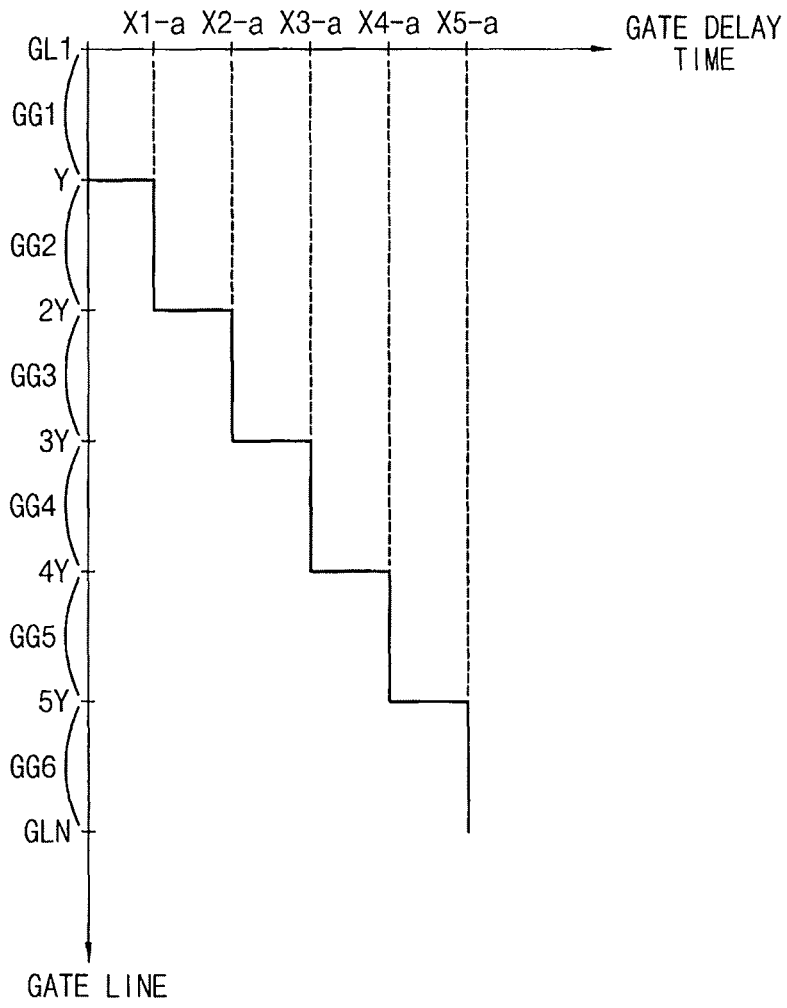
FIG. 6C is a graph illustrating gate delay values of gate signals for gate lines of FIG. 1 during a third frame according to an exemplary embodiment of the present invention.
Figure 7A:
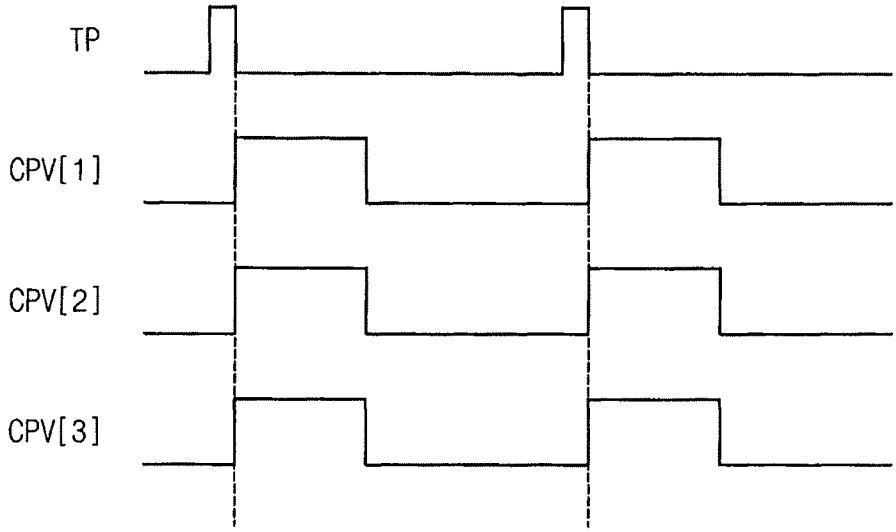
FIGS. 7A and 7B are waveform diagrams illustrating gate clock signals generated by a signal controller of FIG. 1 during first to third frames according to an exemplary embodiment of the present invention.
Figure 7B:
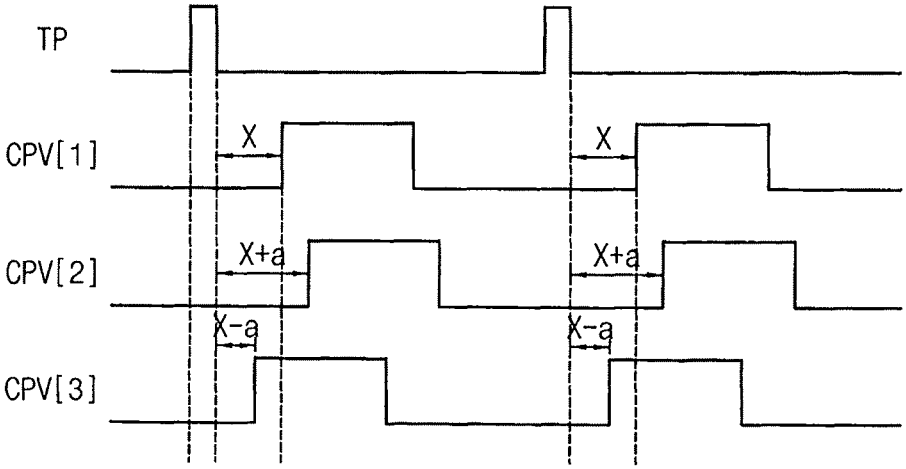

FIG. 6A is a graph illustrating gate delay values of gate signals for gate lines of FIG. 1 during a first frame according to an exemplary embodiment of the present invention. FIG. 6B is a graph illustrating gate delay values of gate signals for gate lines of FIG. 1 during a second frame according to an exemplary embodiment of the present invention. FIG. 6C is a graph illustrating gate delay values of gate signals for gate lines of FIG. 1 during a third frame. FIGS. 7A and 7B are waveform diagrams illustrating gate clock signals generated by a signal controller of FIG. 1 during first to third frames according to an exemplary embodiment of the present invention.

Referring to FIGS. 6A to 6C, a gate delay value varies according to a frame. For example, a gate delay value is applied to gate lines during a first frame and a gate delay value is applied to the gate lines during a second frame, which e.g., follows the first frame. The gate delay value during the first frame is different from the gate delay value during the second frame.

For example, during the first frame, no gate delay value is applied to first-group gate lines GL1 to GLY corresponding to the first gate line group GG1, a gate delay value of X1 is applied to second-group gate lines GL(Y+1) to GL2Y corresponding to the second gate ling group GG2, a gate delay value of X2 is applied to third-group gate lines GL(2Y+1) to GL3Y corresponding to the third gate ling group GG3, a gate delay value of X3 is applied to fourth-group gate lines GL(3Y+1) to GL4Y corresponding to the fourth gate ling group GG4, a gate delay value of X4 is applied to fifth-group gate lines GL(4Y+1) to GL5Y corresponding to the fifth gate ling group GG5, and a gate delay value of X5 is applied to sixth-group gate lines GL(5Y+1) to GL6Y corresponding to the sixth gate ling group GG6. X2 is greater than X1. X3 is greater than X2. X4 is greater than X3. X5 is greater than X4. For example, X2 may be twice of X1. X3 may be three times of X1. X4 may be four times of X1. X5 may be five times of X1. In an exemplary embodiment of the present invention, during the first frame, a gate delay value of X0 less than X1 may be applied to the first-group gate lines GL1 to GLY corresponding to the first gate line group GG1.

During the second frame, no gate delay value is applied to the first-group gate lines GL1 to GLY, a gate delay value of (X1+a) is applied to the second-group gate lines GL(Y+1) to GL2Y, a gate delay value of (X2+a) is applied to the third-group gate lines GL(2Y+1) to GL3Y, a gate delay value of (X3+a) is applied to the fourth-group gate lines GL(3Y+1) to GL4Y, a gate delay value of (X4+a) is applied to the fifth-group gate lines GL(4Y+1) to GL5Y, and a gate delay value of (X5+a) is applied to the sixth-group gate lines GL(5Y+1) to GL6Y. Here, 'a' is a constant value. 'a' may be less than X1. 'a' may be less than (X2−X1). 'a' may be less than (X3−X2). 'a' may be less than (X4−X3). 'a' may be less than (X5−X4). In an exemplary embodiment of the present invention, during the second frame, a gate delay value of (X0+a) less than (X1+a) may be applied to the first-group gate lines GL1 to GLY.

During a third frame, no gate delay value is applied to the first-group gate lines GL1 to GLY, a gate delay value of (X1−a) is applied to the second-group gate lines GL(Y+1) to GL2Y, a gate delay value of (X2−a) is applied to the third-group gate lines GL(2Y+1) to GL3Y, a gate delay value of (X3−a) is applied to the fourth-group gate lines GL(3Y+1) to GL4Y, a gate delay value of (X4−a) is applied to the fifth-group gate lines GL(4Y+1) to GL5Y, and a gate delay value of (X5−a) is applied to the sixth-group gate lines GL(5Y+1) to GL6Y. In an exemplary embodiment of the present invention, during the third frame, a gate delay value of (X0−a) less than (X1−a) may be applied to the first-group gate lines GL1 to GLY.

The signal generating part 240 of the signal controller 200 may generate the gate clock signal CPV to which the gate delay value is applied. The gate driver 300 may generate the gate signals G1 to GN using the gate clock signal CPV to which the gate delay value is applied.

FIG. 7A illustrates a gate clock signal CPV corresponding to the first gate line group GG1 during the first to third frames.

During the first frame, a gate clock signal CPV[1] has no gate delay value from a falling edge of the load signal TP. During the second frame, a gate clock signal CPV[2] has no gate delay value from the falling edge of the load signal TP. During the third frame, a gate clock signal CPV[3] has no gate delay value from the falling edge of the load signal TP.

FIG. 7B illustrates a gate clock signal CPV corresponding to the second gate line group GG2 during the first to third frames.

During the first frame, the gate clock signal CPV[1] has the gate delay value of X1 from a falling edge of the load signal TP. During the second frame, the gate clock signal CPV[2] has the gate delay value of (X1+a), which is different from the gate delay value of X in the first frame, from a falling edge of the load signal TP.

During the third frame, the gate clock signal CPV[3] has the gate delay value of (X1−a) from a falling edge of the load signal TP. The gate delay value of (X1−a) in the third frame may be different from the gate delay value of X1 in the first frame and the gate delay value of (X1+a) in the second frame.

For example, the signal controller 200 does not apply a gate delay value to gate clock signals CPV[1], CPV[2], and CPV[3] corresponding to the first gate line group GG1. For example, the gate signals corresponding to the first gate line group GG1 may be respectively generated based on the gate clock signals CPV[1], CPV[2], and CPV[3] corresponding to the first gate line group GG1.

The signal controller 200 applies different gate delay values X1, (X1+a), and (X1−a) according to the frames to gate clock signals CPV[1], CPV[2], and CPV[3] corresponding to the second gate line group GG2. The gate clock signals CPV[1], CPV[2], and CPV[3] may have different timings (e.g., turn-on timings) from each other according to the frames. For example, the gate signals corresponding to the second gate line group GG2 may be generated based on the gate clock signals CPV[1], CPV[2], and CPV[3] corresponding to the second gate line group GG2.

Although it is illustrated that the gate delay value varies over three frames (e.g., the first to third frames), the present invention is not limited thereto. For example, the gate delay value may vary in a cycle of three frames. For example, the gate delay value may vary in a cycle of n frames (n is a natural number, for example, two). Accordingly, gate clock signals corresponding to the same gate line may have different gate delay values in two subsequent frames. For example, the gate delay value may vary in a cycle of four frames. Accordingly, gate clock signals corresponding to the same gate line may have different gate delay values in four subsequent frames.

In addition, the gate clock signals CPV[1], CPV[2], and CPV[3] corresponding to the third gate line group GG3 may have gate delay values of X2, (X2+a), and (X2−a), respectively, during the first to third frames. For example, a pattern in which the gate delay values of the gate clock signals CPV[1], CPV[2], and CPV[3] corresponding to the third gate line group GG3 vary according to the frames may be different from a pattern in which the gate delay values of the gate clock signal CPV[1], CPV[2], and CPV[3] corresponding to the second gate line group GG2 vary according to the frames.

In an exemplary embodiment of the present invention, locations of borders among the gate line groups might not be changed according to frames.

According to an exemplary embodiment of the present invention, a gate signal applied to the same gate line has different gate delay value according to a frame and thus, the horizontal line defect due to the difference in the charging rates of the pixels at the borders among the gate line groups may be reduced or prevented. Thus, display quality of the display panel 100 may be increased.

Figure 8A:
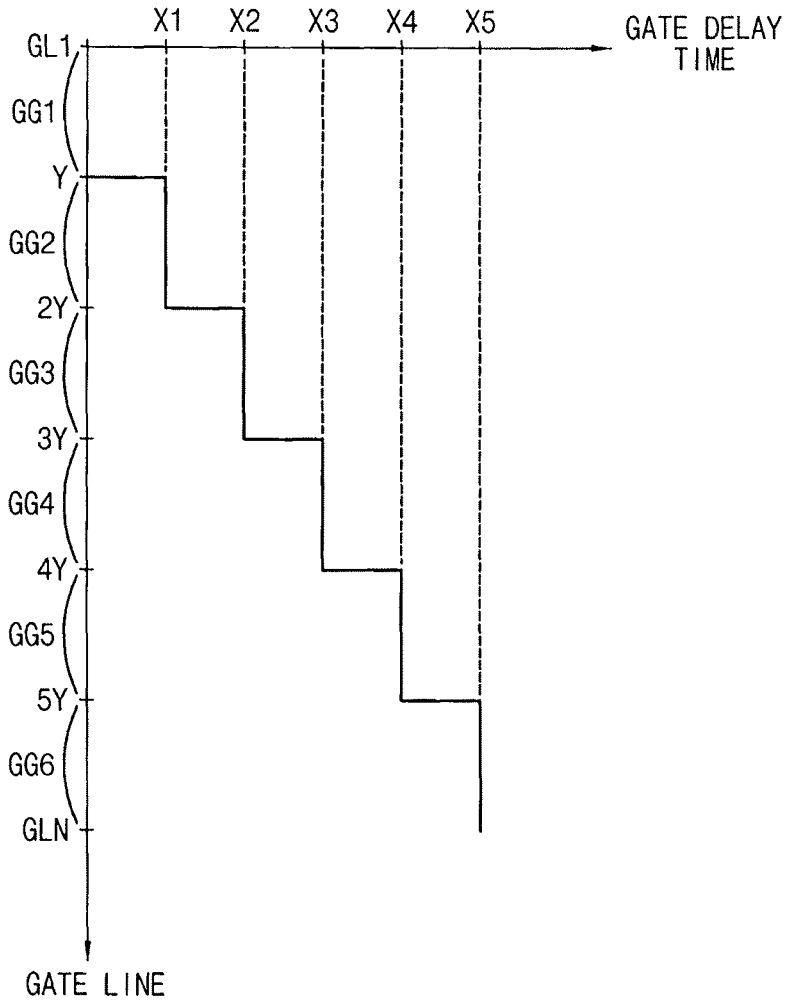
FIG. 8A is a graph illustrating gate delay values of gate signals for gate lines of a display apparatus according to an exemplary embodiment of the present invention during a first frame.
Figure 8B:
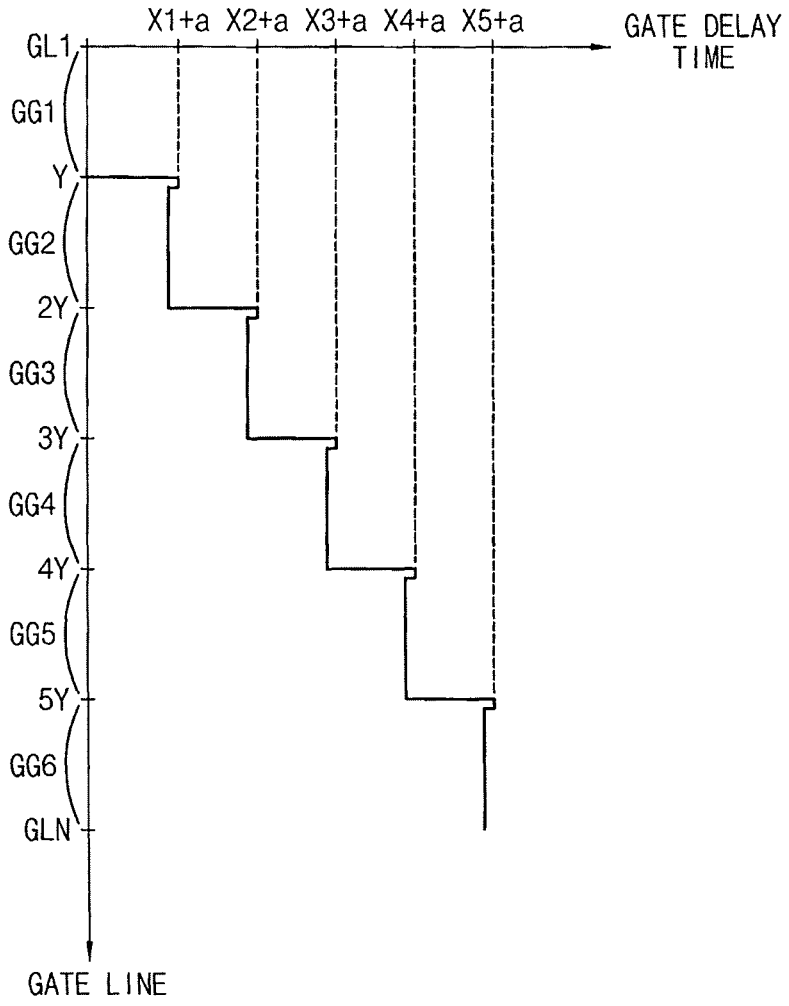
FIG. 8B is a graph illustrating gate delay values of the gate signals for gate lines of FIG. 8A during a second frame according to an exemplary embodiment of the present invention.
Figure 8C:
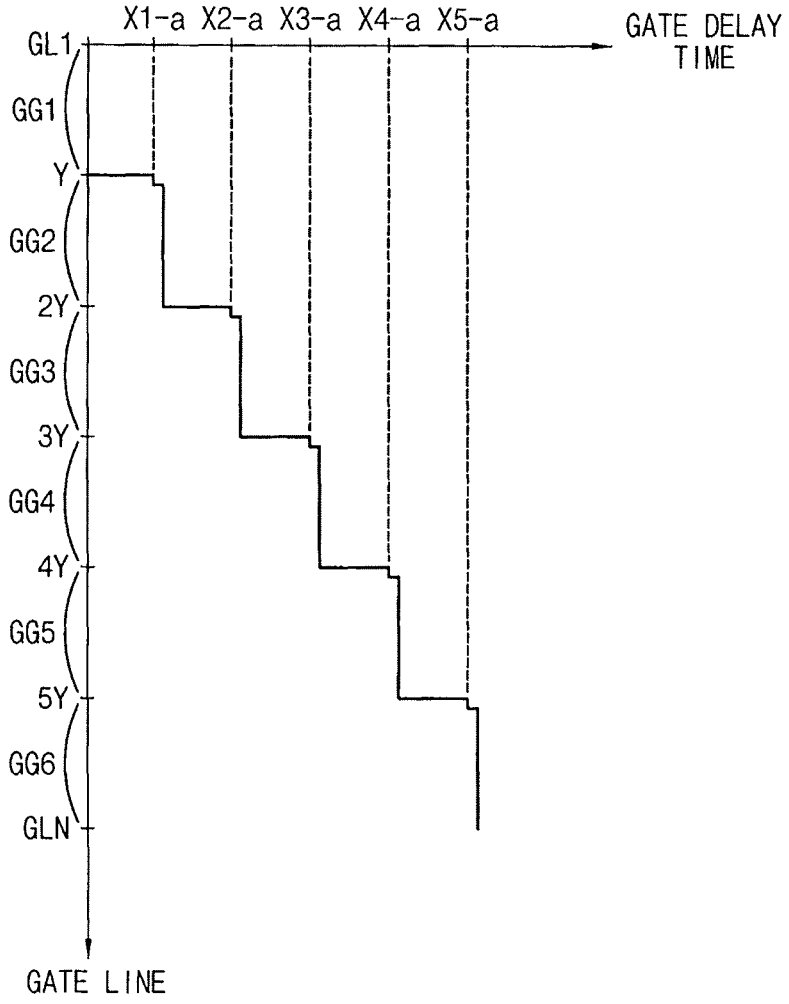
FIG. 8C is a graph illustrating gate delay values of the gate signals for gate lines of FIG. 8A during a third frame according to an exemplary embodiment of the present invention.

FIG. 8A is a graph illustrating gate delay values of gate signals for gate lines of a display apparatus according to an exemplary embodiment of the present invention during a first frame. FIG. 8B is a graph illustrating gate delay values of the gate signals for gate lines of FIG. 8A during a second frame according to an exemplary embodiment of the present invention. FIG. 8C is a graph illustrating gate delay values of the gate signals for gate lines of FIG. 8A during a third frame according to an exemplary embodiment of the present invention.

A method of driving a display panel and a display apparatus in connection with FIGS. 8A to 8C is substantially the same as the method of driving the display panel and the display apparatus in connection with FIGS. 1, 2, 3A, 3B, 4, 5, 6A to 6C, 7A, and 7B except for a different gate delay values applied to a first gate line and gate lines other than the first gate line in each gate line group. Repetitive descriptions will be omitted.

Referring to FIGS. 8A to 8C, a gate delay value varies according to a frame. For example, a gate delay value is applied to gate lines during a first frame and a gate delay value is applied to the gate lines during a second frame, which e.g., follows the first frame. The gate delay value during the first frame is different from the gate delay value during the second frame. In an exemplary embodiment of the present invention, variations of the gate delay values of the gate signals according to the frames may occur only in the borders among the gate line groups.

For example, referring to FIG. 8A, during the first frame, no gate delay value is applied to first-group gate lines GL1 to GLY corresponding to the first gate line group GG1, a gate delay value of X1 is applied to second-group gate lines GL(Y+1) to GL2Y corresponding to the second gate ling group GG2, a gate delay value of X2 is applied to third-group gate lines GL(2Y+1) to GL3Y corresponding to the third gate ling group GG3, a gate delay value of X3 is applied to fourth-group gate lines GL(3Y+1) to GL4Y corresponding to the fourth gate ling group GG4, a gate delay value of X4 is applied to fifth-group gate lines GL(4Y+1) to GL5Y corresponding to the fifth gate ling group GG5, and a gate delay value of X5 is applied to sixth-group gate lines GL(5Y+1) to GL6Y corresponding to the sixth gate ling group GG6. In an exemplary embodiment of the present invention, during the first frame, a gate delay value of X0 less than X1 may be applied to the first-group gate lines GL1 to GLY corresponding to the first gate line group GG1.

Referring to FIG. 8B, during the second frame, no gate delay value is applied to the gate lines corresponding to the first gate line group GG1. During the second frame, a gate delay value of (X1+a) is applied to a first gate line of the second-group gate lines GL(Y+1) to GL2Y and the gate delay value of X1 is applied to gate lines of the second-group gate lines GL(Y+1) to GL2Y except for the first gate line of the second-group gate lines GL(Y+1) to GL2Y. During the second frame, a gate delay value of (X2+a) is applied to a first gate line of the third-group gate lines GL(2Y+1) to GL3Y and the gate delay value of X2 is applied to gate lines of the third-group gate lines GL(2Y+1) to GL3Y except for the first gate line of the third-group gate lines GL(2Y+1) to GL3Y. During the second frame, a gate delay value of (X3+a) is applied to a first gate line of the fourth-group gate lines GL(3Y+1) to GL4Y and the gate delay value of X3 is applied to gate lines of the fourth-group gate lines GL(3Y+1) to GL4Y except for the first gate line of the fourth-group gate lines GL(3Y+1) to GL4Y. During the second frame, a gate delay value of (X4+a) is applied to a first gate line of the fifth-group gate lines GL(4Y+1) to GL5Y and the gate delay value of X4 is applied to gate lines of the fifth-group gate lines GL(4Y+1) to GL5Y except for the first gate line of the fifth-group gate lines GL(4Y+1) to GL5Y. During the second frame, a gate delay value of (X5+a) is applied to a first gate line of the sixth-group gate lines GL(5Y+1) to GL6Y and the gate delay value of X5 is applied to gate lines of the sixth-group gate lines GL(5Y+1) to GL6Y except for the first gate line of the sixth-group gate lines GL(5Y+1) to GL6Y. In an exemplary embodiment of the present invention, during the second frame, a gate delay value of X0 less than X1 may be applied to the first-group gate lines GL1 to GLY.

Referring to FIG. 8C, during the third frame, no gate delay value is applied to the gate lines corresponding to the first gate line group GG1. During the third frame, a gate delay value of (X1−a) is applied to a first gate line of the second-group gate lines GL(Y+1) to GL2Y and the gate delay value of X1 is applied to gate lines of the second-group gate lines GL(Y+1) to GL2Y except for the first gate line of the second-group gate lines GL(Y+1) to GL2Y. During the third frame, a gate delay value of (X2−a) is applied to a first gate line of the third-group gate lines GL(2Y+1) to GL3Y and the gate delay value of X2 is applied to gate lines of the third-group gate lines GL(2Y+1) to GL3Y except for the first gate line of the third-group gate lines GL(2Y+1) to GL3Y. During the third frame, a gate delay value of (X3−a) is applied to a first gate line of the fourth-group gate lines GL(3Y+1) to GL4Y and the gate delay value of X3 is applied to gate lines of the fourth-group gate lines GL(3Y+1) to GL4Y except for the first gate line of the fourth-group gate lines GL(3Y+1) to GL4Y. During the third frame, the gate delay value of (X4−a) is applied to a first gate line of the fifth-group gate lines GL(4Y+1) to GL5Y and the gate delay value of X4 is applied to gate lines of the fifth-group gate lines GL(4Y+1) to GL5Y except for the first gate line of the fifth-group gate lines GL(4Y+1) to GL5Y. During the third frame, a gate delay value of (X5−a) is applied to a first gate line of the sixth-group gate lines GL(5Y+1) to GL6Y and the gate delay value of X5 is applied to gate lines of the sixth-group gate lines GL(5Y+1) to GL6Y except for the first gate line of the sixth-group gate lines GL(5Y+1) to GL6Y. In an exemplary embodiment of the present invention, during the third frame, a gate delay value of X0 less than X1 may be applied to the first-group gate lines GL1 to GLY.

For example, gate clock signals CPV[1], CPV[2], and CPV[3] corresponding to the first gate line of the second-group gate lines GL(Y+1) to GL2Y has waveforms, as shown in FIG. 7B during the first to third frames.

According to an exemplary embodiment of the present invention, gate signals applied to the same gate line may have different delay values according to the frames and thus, the horizontal line defect due to the difference in the charging rates of the pixels at the border areas among the gate line groups may be reduced or prevented. Thus, display quality of the display panel 100 may be increased.

Figure 9A:
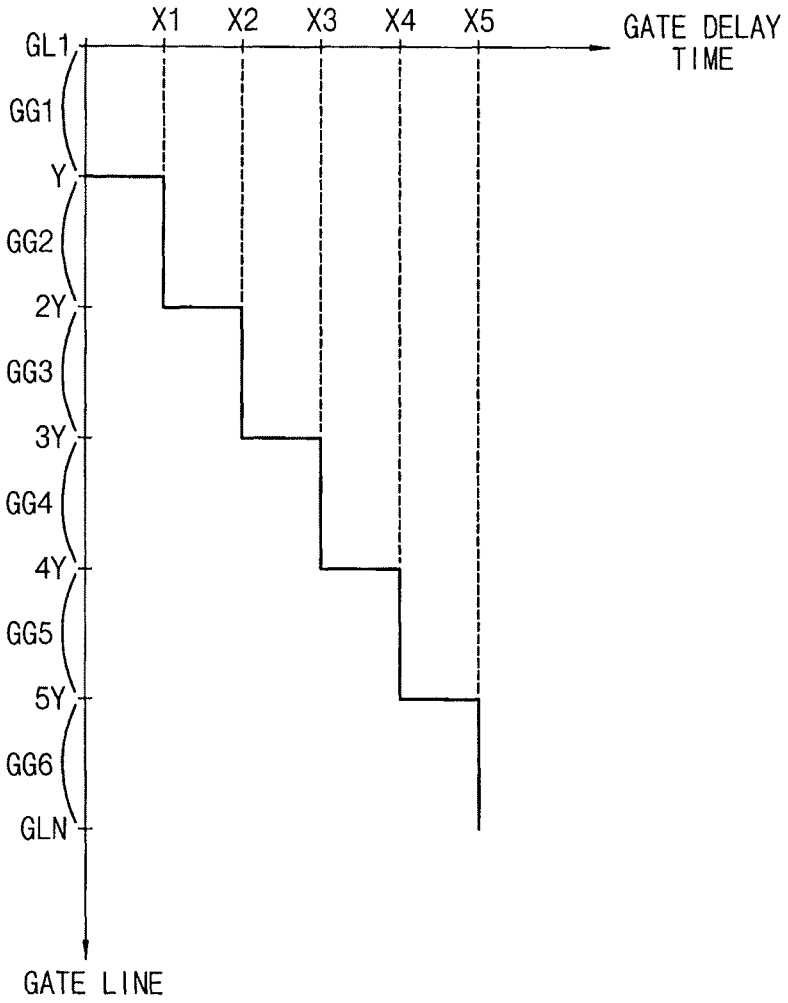
FIG. 9A is a graph illustrating gate delay values of the gate signals for gate lines of a display apparatus according to an exemplary embodiment of the present invention during a first frame.
Figure 9B:
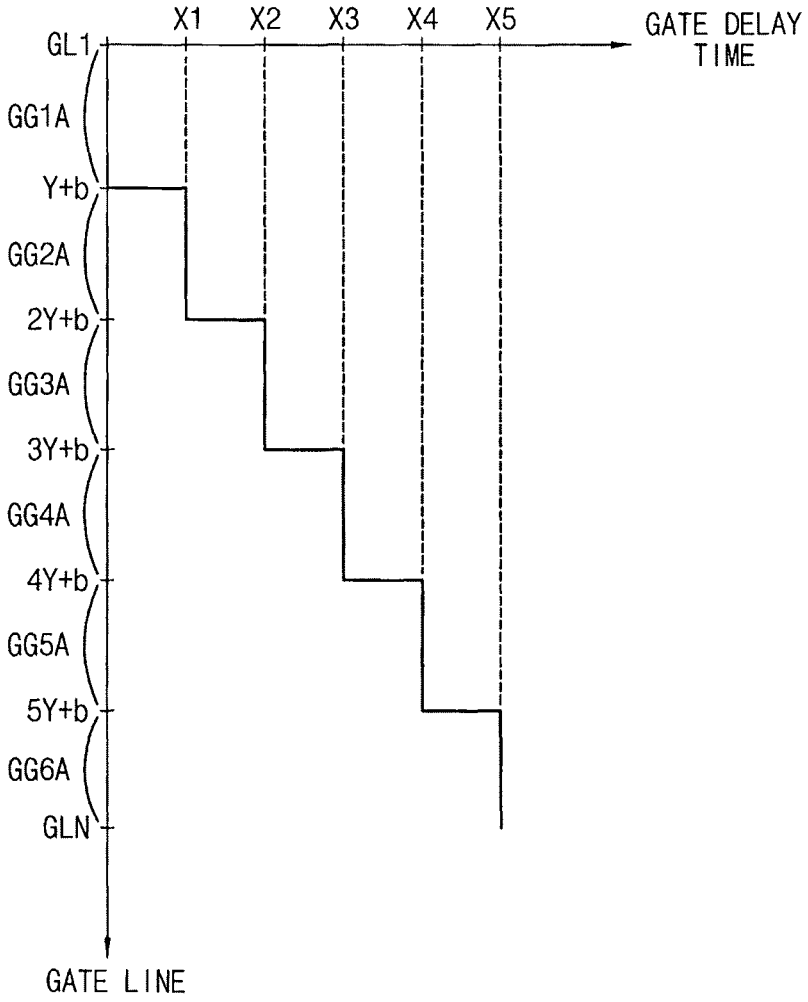
FIG. 9B is a graph illustrating gate delay values of the gate signals for gate lines of FIG. 9A during a second frame according to an exemplary embodiment of the present invention.
Figure 9C:
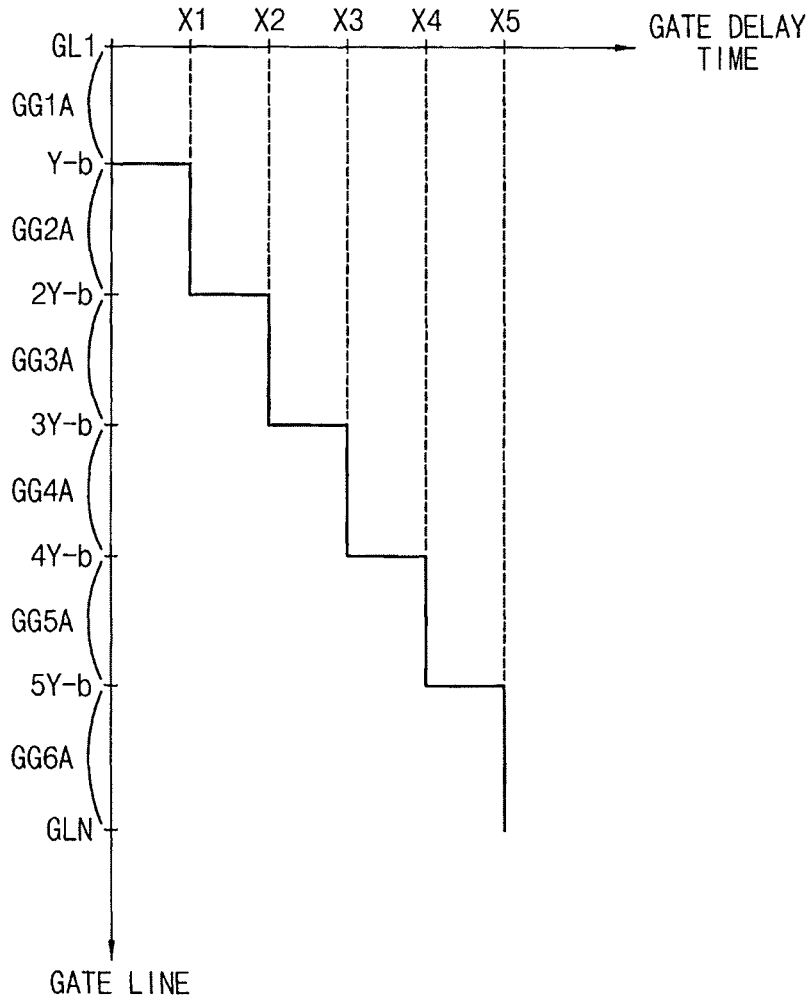
FIG. 9C is a graph illustrating gate delay values of the gate signals for gate lines of FIG. 9A during a third frame according to an exemplary embodiment of the present invention.
Figure 10:
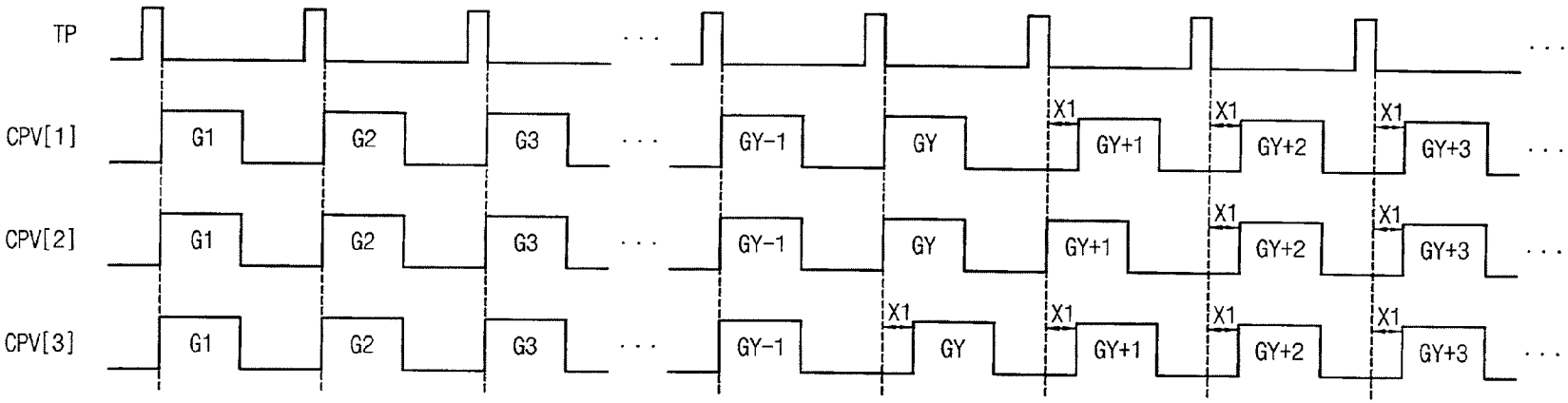
FIG. 10 is a waveform diagrams illustrating a gate clock signal generated by a signal controller of the display apparatus of FIG. 9A during first to third frames according to an exemplary embodiment of the present invention.
Figure 11:
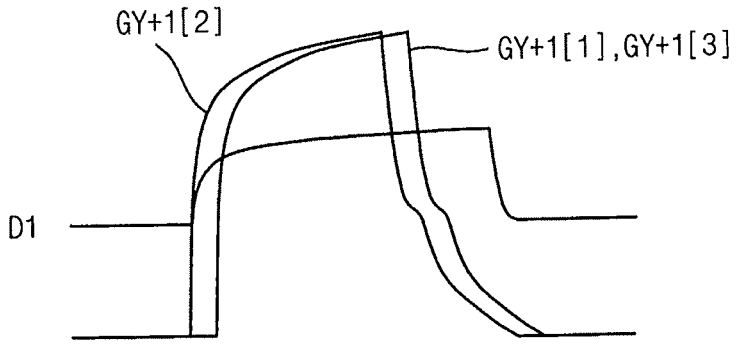
FIG. 11 is a waveform diagram illustrating a gate signal applied to a Y-th gate line of the display apparatus of FIG. 9A according to an exemplary embodiment of the present invention.

FIG. 9A is a graph illustrating gate delay values of gate signals for gate lines of a display apparatus according to an exemplary embodiment of the present invention during a first frame. FIG. 9B is a graph illustrating gate delay values of the gate signals for gate lines of FIG. 9A during a second frame according to an exemplary embodiment of the present invention. FIG. 9C is a graph illustrating gate delay values of the gate signals for gate lines of FIG. 9A during a third frame according to an exemplary embodiment of the present invention. FIG. 10 is a waveform diagrams illustrating a gate clock signal generated by a signal controller of the display apparatus of FIG. 9A during first to third frames according to an exemplary embodiment of the present invention. FIG. 11 is a waveform diagram illustrating a gate signal applied to a Y-th gate line of the display apparatus of FIG. 9A according to an exemplary embodiment of the present invention.

A method of driving a display panel and a display apparatus in connection with FIGS. 9A to 9C, 10, and 11 is substantially the same as the method of driving the display panel and the display apparatus in connection with FIGS. 1, 2, 3A, 3B, 4, 5, 6A to 6C, 7A, and 7B except for borders among the gate line groups. Repetitive descriptions will be omitted.

Referring to FIGS. 9A to 9C, a gate delay value for each gate line group does not vary according to frames. Locations of borders among the gate line groups may vary according to the frames. For example, a gate delay value is applied to gate lines during a first frame and a gate delay value is applied to the gate lines during a second frame, which e.g., follows the first frame. The gate delay value during the first frame is different from the gate delay value during the second frame. In an exemplary embodiment of the present invention, variations of the gate delay values of the gate signals according to the frames may occur only in the borders among the gate line groups.

For example, referring to FIG. 9A, during the first to third frames, no gate delay value is applied to first-group gate lines corresponding the first gate line group GG1, a gate delay value of X1 is applied to second-group gate lines corresponding to the second gate line group GG2, a gate delay value of X2 is applied to third-group gate lines corresponding to the third gate line group GG3, a gate delay value of X3 is applied to fourth-group gate lines corresponding to the fourth gate line group GG4, a gate delay value of X4 is applied to fifth-group gate lines corresponding to the fifth gate line group GG5, and a gate delay value of X5 is applied to sixth-group gate lines corresponding to the sixth gate line group GG6.

During the first frame, a border between the first gate line group GG1 and the second gate line group GG2 may be formed at a Y-th gate line (Y is a natural number), a border between the second gate line group GG2 and the third gate line group GG3 may be formed at a 2Y-th gate line, a border between the third gate line group GG3 and the fourth gate line group GG4 may be formed at a 3Y-th gate line, a border between the fourth gate line group GG4 and the fifth gate line group GG5 may be formed at a 4Y-th gate line, and a border between the fifth gate line group GG5 and the sixth gate line group GG6 may be formed at a 5Y-th gate line. For example, the last gate line in the first gate line group GG1 may be the Y-th gate line. For example, the last gate line in the second gate line group GG2 may be the 2Y-th gate line. For example, the last gate line in the third gate line group GG3 may be the 3Y-th gate line. For example, the last gate line in the fourth gate line group GG4 may be the 4Y-th gate line. For example, the last gate line in the fifth gate line group GG5 may be the 5Y-th gate line.

Referring to FIG. 9B, during the second frame, the border between the first gate line group GG1 and the second gate line group GG2 may be formed at a (Y+b)-th gate line, the border between the second gate line group GG2 and the third gate line group GG3 may be formed at a (2Y+b)-th gate line, the border between the third gate line group GG3 and the fourth gate line group GG4 may be formed at a (3Y+b)-th gate line, the border between the fourth gate line group GG4 and the fifth gate line group GG5 may be formed at a (4Y+b)-th gate line, and the border between the fifth gate line group GG5 and the sixth gate line group GG6 may be formed at a (5Y+b)-th gate line. For example, the last gate line in the first gate line group GG1 may be the (Y+b)-th gate line. For example, the last gate line in the second gate line group GG2 may be the (2Y+b)-th gate line. For example, the last gate line in the third gate line group GG3 may be the (3Y+b)-th gate line. For example, the last gate line in the fourth gate line group GG4 may be the (4Y+b)-th gate line. For example, the last gate line in the fifth gate line group GG5 may be the (5Y+b)-th gate line.

Referring to FIG. 9C, during the third frame, the border between the first gate line group GG1 and the second gate line group GG2 may be formed at a (Y−b)-th gate line, the border between the second gate line group GG2 and the third gate line group GG3 may be formed at a (2Y−b)-th gate line, the border between the third gate line group GG3 and the fourth gate line group GG4 may be formed at a (3Y−b)-th gate line, the border between the fourth gate line group GG4 and the fifth gate line group GG5 may be formed at a (4Y−b)-th gate line and the border between the fifth gate line group GG5 and the sixth gate line group GG6 may be formed at a (5Y−b)-th gate line. For example, the last gate line in the first gate line group GG1 may be the (Y−b)-th gate line, the last gate line in the second gate line group GG2 may be the (2Y−b)-th gate line, the last gate line in the third gate line group GG3 may be the (3Y−b)-th gate line, the last gate line in the fourth gate line group GG4 may be the (4Y−b)-th gate line, and the last gate line in the fifth gate line group GG5 may be the (5Y−b)-th gate line.

For example, during the first to third frame, locations of the border between the first gate line group GG1 and the second gate line group GG2 may vary in the Y-th gate line, (Y+b)-th gate line, and (Y−b)-th gate line.

'b' may be a natural number. For example, 'b' may be one.

For example, referring to FIG. 10, when b is one, a gate clock signal CPV corresponding to a (Y−1)-th gate line may have a gate delay value of zero during the first to third frame.

For example, when b is one, the gate clock signal CPV corresponding to the Y-th gate line may have the gate delay value of zero during the first and second frames and a gate delay value of X1 during the third frame. Thus, the gate signal applied to the Y-th gate line may be generated using the gate clock signal CPV having different gate delay values according to the frames.

For example, when b is one, the gate clock signal CPV corresponding to the (Y+1)-th gate line may have the gate delay value of X1 during the first and third frames and the gate delay value of zero during the second frame. Thus, the gate signal applied to the (Y+1)-th gate line may be generated using the gate clock signal CPV having different gate delay value according to the frames.

Referring to FIG. 11, a gate signal GY+1 applied to the (Y+1)-th gate line has a gate delay value which varies according to the frames. For example, the gate signal GY+1 applied to the (Y+1)-th gate line has a gate delay value of X1 during the first frame. For example, the gate signal GY+1 applied to the (Y+1)-th gate line has a gate delay value of zero during the second frame. For example, the gate signal GY+1 applied to the (Y+1)-th gate line has a gate delay value of X1 during the third frame.

Thus, when a waveform of the gate signal GY+1 applied to the (Y+1)-th gate line is observed using a measurement device such as an oscilloscope, or the like, the gate signal may be overlapped with a data voltage D1 differently according to the frames.

According to an exemplary embodiment of the present invention, a gate signal applied to the same gate line has a different gate delay value according to a frame, and thus, the horizontal line defect due to the difference in the charging rates of the pixels at the borders among the gate line groups may be reduced or prevented. Thus, display quality of the display panel 100 may be increased.

According to an exemplary embodiment of the present invention, as described above, a propagation delay of a data voltage may be compensated by applying a different gate delay value according to a frame, and thus, a charging rate of a pixel is increased and the horizontal line defect may be reduced and prevented. Thus, display quality of the display panel may be increased.

The foregoing is illustrative of the present invention and is not to be construed as limiting thereof. Although a few exemplary embodiments thereof have been described, it will be understood that various modifications in form and details may be made therein without materially departing from the spirit and scope of the present invention. Accordingly, it may be understood that the all such modifications are intended to be included within the scope of the inventive concept as defined in the claims.

What is claimed is:

1. A method of driving a display device including a display panel, wherein the display panel includes a plurality of data lines and a plurality of gate line groups each having a plurality of gate lines, the method comprising:

applying different gate delay values to each of the gate line groups to generate gate signals delayed by the gate delay values with respect to a corresponding timing signal for the data lines; and outputting the gate signals to the gate lines, wherein a first gate delay value is applied to at least one of the gate lines of a first gate line group of the gate line groups during a first frame, a second gate delay value different from the first gate delay value is applied to the at least one of the gate lines of the first gate line group during a second frame temporally succeeding the first frame, and in each of the first and second frames, the gate signals for the first gate line group are activated with respect to different pulses of the timing signal, respectively.

2. The method of claim 1, wherein a gate delay value applied to a P-th gate line group of the gate line groups is less than a gate delay value applied to a Q-th gate line group of the gate line groups, the P-th gate line group being closer than the Q-th gate line group to a data driver of the display device, and wherein P and Q are positive integers.

3. The method of claim 2, wherein a gate delay value applied to the P-th gate line group during the first frame is X, a gate delay value applied to the P-th gate line group during the second frame is (X+a), and wherein X and a are positive real numbers.

4. The method of claim 3, wherein a gate delay value applied to the P-th gate line group during a third frame is (X−a).

5. The method of claim 2, wherein a gate delay value applied to the P-th gate line group during the first frame is X, a gate delay value applied to a first gate line of the P-th gate line group during the second frame is (X+a), and a gate delay value applied to gate lines of the P-th gate line group except for the first gate line of the P-th gate line group during the second frame is X, and wherein X and a are positive real numbers.

6. The method of claim 2, wherein a last gate line in the P-th gate line group is a Y-th gate line of the gate lines during the first frame, and the last gate line of the P-th gate line group is a (Y+b)-th gate line of the gate lines during the second frame, and wherein Y and b are positive integers.

7. The method of claim 6, wherein the last gate line of the P-th gate line group is a (Y−b)-th gate line of the gate lines during a third frame.

8. The method of claim 1, wherein a gate clock signal is generated based on the first gate delay value or the second gate delay value, and the gate signals are generated based on the gate clock signal.

9. The method of claim 1, wherein the timing signal for the data lines is a load signal synchronized with the gate signals, the load signal corresponding to an output timing of a data voltage to a data line of the display device, and the first gate delay value or the second gate delay value is defined with respect to the load signal.

10. A display apparatus comprising:

a display panel including a plurality of data lines and a plurality of gate line groups each having a plurality of gate line;

a gate driver configured to apply different gate delay values to each of the gate line groups to generate gate signals delayed by the gate delay values with respect to a corresponding timing signal for the data lines, and to output the gate signals to the gate lines;

a data driver configured to output data voltages to the data lines; and a signal controller configured to control the gate driver and the data driver, wherein a first gate delay value is applied to at least one of the gate lines of a first gate line group of the gate line groups during a first frame, a second gate delay value different from the first gate delay value is applied to the at least one of the gate lines of the first gate line group during a second frame temporally succeeding the first frame, and in each of the first and second frames, the gate signals for the first gate line group are activated with respect to different pulses of the timing signal, respectively.

11. The display apparatus of claim 10, wherein a gate delay value applied to a P-th gate line group of the gate line groups is less than a gate delay value applied to a Q-th gate line group of the gate line groups, the P-th gate line group being closer than the Q-th gate line group to the data driver, and wherein P and Q are positive integers.

12. The display apparatus of claim 11, wherein a gate delay value applied to the P-th gate line group during the first frame is X, a gate delay value applied to the P-th gate line group during the second frame is (X+a), and wherein X and a are positive real numbers.

13. The display apparatus of claim 12, wherein a gate delay value applied to the P-th gate line group during a third frame is (X−a).

14. The display apparatus of claim 11, wherein a gate delay value applied to the P-th gate line group during the first frame is X, a gate delay value applied to a first gate line of the P-th gate line group during the second frame is (X+a), and a gate delay value applied to gate lines of the P-th gate line group except for the first gate line of the P-th gate line group during the second frame is X, and wherein X and a are positive real numbers.

15. The display apparatus of claim 11, wherein a last gate line of the P-th gate line group is a Y-th gate line of the gate lines during the first frame, and the last gate line of the P-th gate line group is a (Y+b)-th gate line of the gate lines during the second frame, and wherein Y and b are positive integers.

16. The display apparatus of claim 15, wherein the last gate line of the P-th gate line group is a (Y−b)-th gate line of the gate lines during a third frame.

17. The display apparatus of claim 10, wherein the signal controller is configured to generate a gate clock signal based on the first gate delay value or the second gate delay value, and the gate driver is configured to generate the gate signals based on the gate clock signal.

18. The display apparatus of claim 10, wherein the signal controller is configured to generate the timing signal, the timing signal being a load signal corresponding to output timings of the data voltages to the data lines, the gate signals are synchronized with the load signal, and the first gate delay value or the second gate delay value is defined with respect to the load signal.

19. A method of driving a display device including a display panel, wherein the display panel includes a plurality of data lines and a plurality of gate line groups each having a plurality of gate lines, the method comprising:

applying different gate delay values to each of the plurality of gate line groups to generate gate signals delayed by the gate delay values with respect to a corresponding timing signal for the data lines; and outputting the gate signals to the gate lines, wherein a gate delay value applied to a P-th gate line group of the gate line groups is less than a gate delay value of a Q-th gate line group of the gate line groups, the P-th gate line group being closer than the Q-th gate line group to a data driver of the display device, and wherein P and Q are positive integers, and wherein in each of a first frame and a second frame temporally succeeding the first frame, for any of the gate line groups, the gate signals applied to the gate lines thereof are activated with respect to different pulses, respectively, of the timing signal.

20. The method of claim 19, wherein a first gate delay value is applied to at least one of the gate lines during the first frame, and a second gate delay value different from the first gate delay value is applied to the at least one of the gate lines during the second frame, and wherein a gate clock signal is generated based on the first gate delay value or the second gate delay value, and the gate signals are generated based on the gate clock signal.

21. The method of claim 19, wherein the timing signal is a load signal synchronized with the gate signals, the load signal corresponding to an output timing of a data voltage to a data line of the data lines.

22. A display apparatus comprising:

a display panel including a plurality of data lines and a plurality of gate line groups each having a plurality of gate lines;

a gate driver configured to apply different gate delay values to each of the gate line groups to generate gate line signals delayed by the gate delay values with respect to a corresponding timing signal for the data lines, and to output the gate line signals to the gate lines;

a data driver configured to output data voltages to the data lines; and a signal controller configured to control the gate driver and the data driver, wherein in each of a first frame and a second frame temporally succeeding the first frame, for any of the gate line groups, the gate signals applied to the gate lines thereof are activated with respect to different pulses, respectively, of the timing signal.

23. The display apparatus of claim 22, wherein a gate delay value applied to a P-th gate line group of the gate line groups is less than a gate delay value of a Q-th gate line group of the gate line groups, the P-th gate line group being closer than the Q-th gate line group to the data driver, and wherein P and Q are positive integers.

* * * * *